US009163832B2

(12) United States Patent
Johansson et al.

(10) Patent No.: US 9,163,832 B2
(45) Date of Patent: Oct. 20, 2015

(54) WASTE COMBUSTION CHAMBER

(76) Inventors: Stefan Johansson, Costa Mesa, CA (US); Mattias Johansson, Huntington Beach, CA (US)

( * ) Notice: Subject to any disclaimer, the term of this patent is extended or adjusted under 35 U.S.C. 154(b) by 0 days.

(21) Appl. No.: 13/182,221

(22) Filed: Jul. 13, 2011

(65) Prior Publication Data

US 2012/0012040 A1 Jan. 19, 2012

Related U.S. Application Data

(60) Provisional application No. 61/363,955, filed on Jul. 13, 2010.

(51) Int. Cl.
*F23G 5/00* (2006.01)
*F23G 7/00* (2006.01)
(Continued)

(52) U.S. Cl.
CPC ..... *F23G 7/001* (2013.01); *F23G 5/446* (2013.01); *F23G 5/50* (2013.01); *F23G 2203/80* (2013.01);
(Continued)

(58) Field of Classification Search
CPC ..... C02F 1/048; C02F 1/10; C02F 1/12; C02F 1/16; C02F 1/20; C02F 1/52; C02F 1/66; C02F 2103/18; C02F 2201/008; C02F 2209/03; C02F 3/32; C02F 9/00; C02F 1/04; C02F 1/24; C02F 1/72; C02F 1/74; C02F 11/12; C02F 1/38; C02F 1/441; C02F 1/70; C02F 1/78; C02F 2101/10; C02F 2101/101; C02F 2101/30; C02F 2103/06; C02F 2103/26; C02F 2103/34; C02F 2301/063; C02F 2301/066; C02F 3/02; F23G 2203/70; F23G 2203/80; F23G 2203/8013; F23G 2206/203; F23G 2207/112; F23G 2207/20; F23G 2209/12; F23G 2209/281; F23G 2900/54001; F23G 5/002; F23G 5/006; F23G 5/02; F23G 5/027
USPC ..... 110/346, 235–259, 186, 194; 4/111.1
See application file for complete search history.

(56) References Cited

U.S. PATENT DOCUMENTS 3,815,159 A 6/1974 Delaney et al.
3,842,762 A * 10/1974 Sargent et al. ..... 110/212
(Continued)

FOREIGN PATENT DOCUMENTS

JP 07-217838 A 8/1995
KR 10-0240833 B1 10/1999
(Continued)

*Primary Examiner* — Kenneth Rinehart
*Assistant Examiner* — Jason Lau
(74) *Attorney, Agent, or Firm* — Loza & Loza LLP; Anthony G. Smyth

(57) ABSTRACT

A waste incinerator system is disclosed for incinerating waste in a holding tank. The system comprises a pump in fluid communication with the waste, and which is adapted to pump waste out of the holding tank and into a substantially hollow burning chamber. The burning chamber includes a raised open end and a lowered chimney end. The chimney end is sealed with a selectively removable chamber plate and includes a chimney for venting exhaust fumes from within the burning chamber. A waste tray is adapted to be slid into the burning chamber through the chimney end and holds waste received from the pump. A burner assembly is fixed adjacent with the open end of the burning chamber and adapted to direct a flame into the open end of the burning chamber to heat the waste tray and incinerate the waste therein. A housing is included to enclose the burner assembly and the burning chamber.

19 Claims, 3 Drawing Sheets

(51) Int. Cl.
*F23G 5/44* (2006.01)
*F23G 5/50* (2006.01)

(52) U.S. Cl.
CPC ..... *F23G 2207/112* (2013.01); *F23G 2207/20* (2013.01); *F23G 2209/12* (2013.01); *F23G 2900/54001* (2013.01)

(56) References Cited

U.S. PATENT DOCUMENTS

| | | | | | |
|---|---|---|---|---|---|
| 4,213,864 | A | | 7/1980 | Asikainen | |
| 4,359,789 | A | * | 11/1982 | Roberts | 4/300 |
| 4,753,176 | A | * | 6/1988 | Duran | 110/194 |
| 4,889,484 | A | * | 12/1989 | Przewalski | 432/103 |
| 5,156,098 | A | | 10/1992 | Camp | |
| 5,265,544 | A | * | 11/1993 | Bigelow et al. | 110/345 |
| 5,410,973 | A | * | 5/1995 | Kunstler et al. | 110/246 |
| 5,727,481 | A | * | 3/1998 | Voorhees et al. | 110/237 |
| 6,126,907 | A | * | 10/2000 | Wada | 422/184.1 |
| 6,244,196 | B1 | * | 6/2001 | Kimberlin | 110/317 |
| 6,405,663 | B1 | * | 6/2002 | Jones | 110/342 |
| 6,422,159 | B1 | * | 7/2002 | Hunter | 110/214 |
| 6,619,214 | B2 | * | 9/2003 | Walker | 110/229 |
| 6,745,407 | B1 | * | 6/2004 | Van Acker, Jr. | 4/111.4 |
| 6,763,528 | B2 | | 7/2004 | West | |
| 7,019,190 | B1 | * | 3/2006 | Lucas et al. | 588/320 |
| 2006/0206996 | A1 | | 9/2006 | Lumbert | |
| 2007/0062423 | A1 | | 3/2007 | Johansson et al. | |
| 2011/0119816 | A1 | | 5/2011 | Aslaksen | |

FOREIGN PATENT DOCUMENTS

| | | | |
|---|---|---|---|
| KR | 10-0240833 | B1 | 1/2000 |
| WO | WO 94/06338 | A1 | 3/1994 |
| WO | WO 2004/018937 | A2 | 3/2004 |
| WO | WO 2006/079906 | A2 | 8/2006 |

* cited by examiner

WASTE COMBUSTION CHAMBER

CROSS-REFERENCE TO RELATED APPLICATIONS

This application is a non-provisional utility patent application that claims priority to U.S. provisional utility patent application 61/363,955, filed on Jul. 13, 2010, and incorporated herein by reference.

STATEMENT REGARDING FEDERALLY SPONSORED RESEARCH AND DEVELOPMENT

Not Applicable.

FIELD OF THE INVENTION

This invention relates to waste management, and more particularly to a waste incineration system.

DISCUSSION OF RELATED ART

It is known in the art to incinerate sewage, gray water, and other waste products of a plumbing system. Non-combustible waste products, such as ash materials, tend to accumulate over time in such systems, and must be manually removed. Heretofore, no easy way of removing such accumulated materials has been devised. Further, systems of the prior art have lacked in efficiency and made such systems expensive to operate.

Such prior art devices with efficiency and ease-of-use drawbacks include the following:

| Publication No. | Publication Date. | Inventor |
|---|---|---|
| U.S. Pat. No. 3,815,159 | Jun. 11, 1974 | Delaney et al. |
| U.S. Pat. No. 4,213,864 | Jul. 22, 1980 | Asikainen |
| U.S. Pat. No. 4,359,789 | Nov. 23, 1982 | Roberts |
| U.S. Pat. No. 5,265,544 | Nov. 30, 1993 | Bigelow et al. |
| U.S. Pat. No. 6,745,407 | Jun. 8, 2004 | Van Acker, Jr. |
| U.S. Pat. No. 6,763,528 | Jul. 20, 2004 | West |
| US 2006/0206996 | Sep. 21, 2006 | Lumbert |
| US 2007/0062423 | Mar. 22, 2007 | Johansson et al. |
| WO 94/06338 | Mar. 31, 1994 | Blankenship |
| WO 2004/018937 | Mar. 4, 2004 | West |
| WO 2006/079906 | Aug. 3, 2006 | Sjovik |

Therefore, there is a need for a device that allows for easy removal of non-combustible ash byproduct materials, while at the same time improves efficiency over the prior art. Such a needed system would be relatively easy to install in a wide variety of applications, and would be relatively inexpensive to manufacture and operate. The present invention accomplishes these objectives.

SUMMARY OF THE INVENTION

The present device is a waste incinerator system for incinerating waste from a holding tank. The system may include a waste level sensor for sensing a waste level within the holding tank. Such a holding tank may be an outhouse holding tank, a septic tank, or other holding tank for holding sewage or gray water from a plumbing system, for example.

The system comprises a pump in fluid communication with the waste from the holding tank, and which is adapted to pump waste out of the holding tank and into a substantially hollow burning chamber. The burning chamber includes a raised open end and a lowered chimney end. The chimney end is sealed with a selectively removable chamber plate and includes a chimney for venting exhaust fumes from within the burning chamber.

A waste tray is adapted to be slid into the burning chamber through the chimney end when the chamber plate is removed. The waste tray holds waste received from the pump. The waste tray may further include heat sink fins, and is preferably made of a suitably high-temperature metal or alloy that is able to transmit heat efficiently, such that applying heat to one side thereof generally heats the entire waste tray. A burner assembly is fixed adjacent with the open end of the burning chamber and adapted to direct a flame into the open end of the burning chamber to heat the waste tray and the waste therein. A housing is included to enclose the burner assembly and the burning chamber.

A control system includes a power source and is adapted to activate the pump and the burner assembly. The control system includes at least one temperature sensor fixed proximate the chimney for determining when the burning chamber has reached a predetermined temperature.

In use, when the waste level sensor of the holding tank indicates that a waste level in the holding tank has exceeded a predetermined level, such as 60% capacity, for example, the control system activates the pump for a predetermined time, such as between 5 and 20 seconds, in order to pump a predetermined volume of the waste into the waste tray, such as between 0.25 and 2.5 gallons, for example. The control system then activates the burner assembly after the predetermined time of pumping and until the burning chamber has reached the predetermined temperature, indicating that the waste has been incinerated. More waste can then be pumped into the waste tray and incinerated in the same manner, until the waste level sensor indicates that the waste level in the holding tank has fallen to a predetermined minimum level, such as 5% of capacity, for example.

The present invention is a system that allows for easy removal of non-combustible ash byproduct materials, while at the same time improves efficiency over the prior art. The present device is relatively easy to install in a wide variety of applications, and is relatively inexpensive to manufacture and operate. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
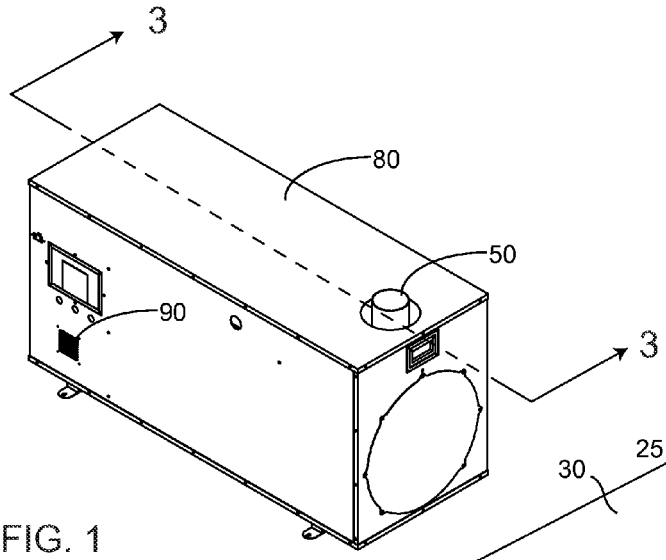
FIG. 1 is a perspective view of a housing of the invention.
Figure 3:
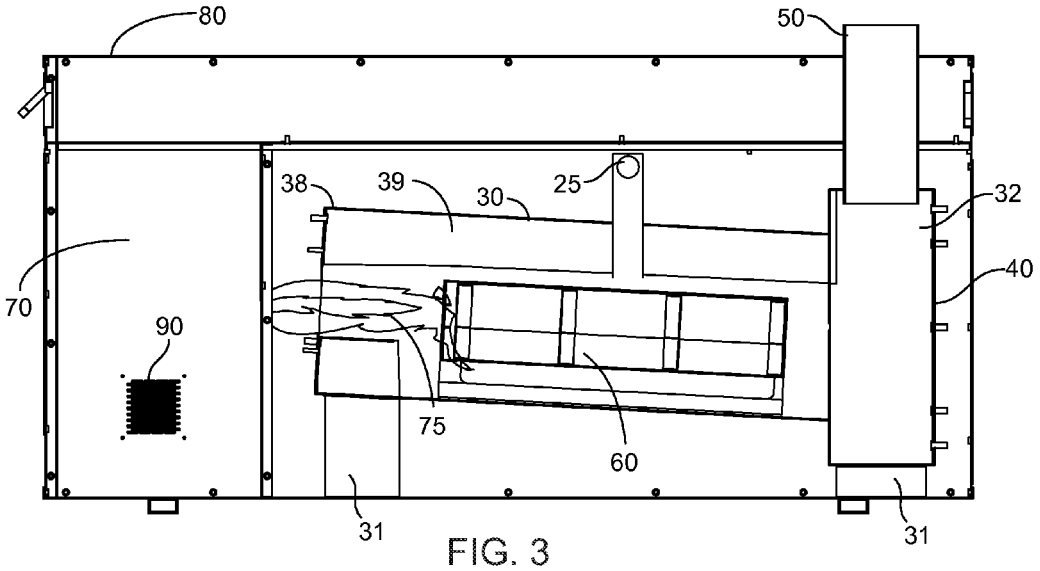
FIG. 3 is a cross-sectional view of the invention, taken generally alone lines 3-3 of FIG. 1.
Figure 4:
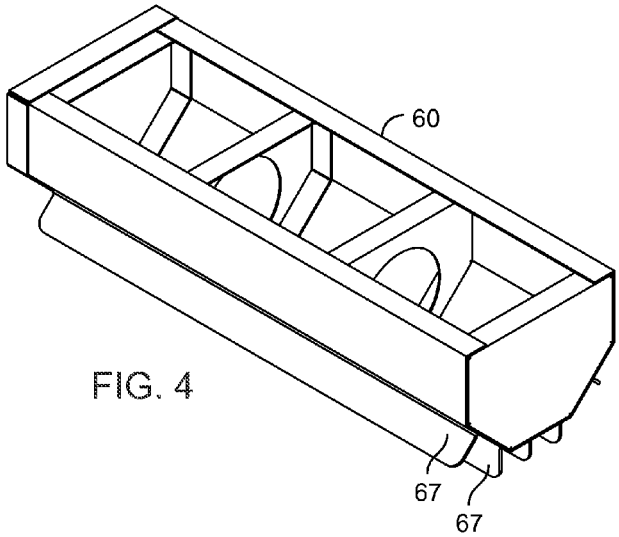
FIG. 4 is a perspective view of a waste tray of one embodiment of the invention.
Figure 5:
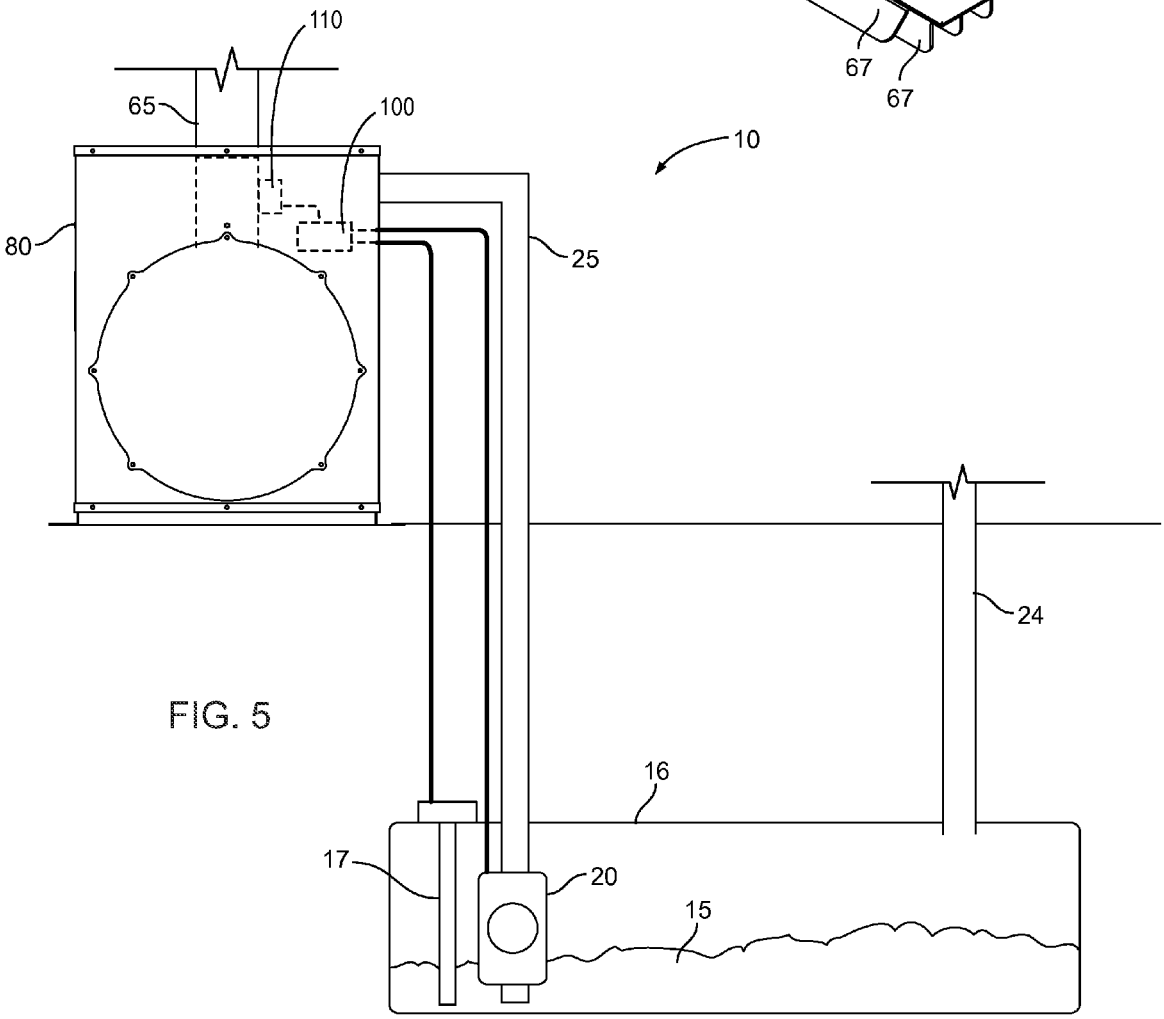
FIG. 5 is a diagram of the invention, illustrating a waste holding tank buried below a ground surface upon which the housing is mounted.
Figure 6:
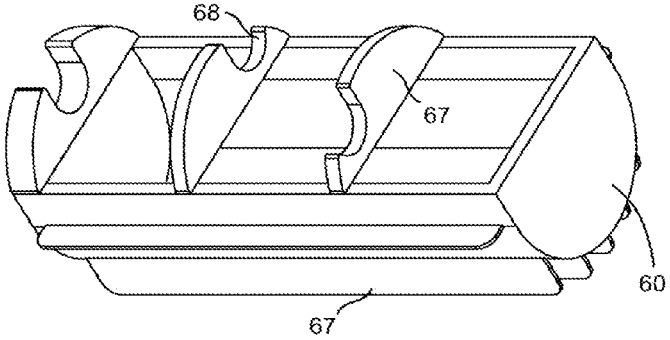
FIG. 6 is a perspective view of an alternate embodiment of the waste tray.

FIGS. 1, 3 and 5 illustrate a waste incinerator system 10 for incinerating waste 15 in a holding tank 16. The system 10 may include a waste level sensor 17 for sensing a waste level within the holding tank 16, or may utilize the signal from a waste level sensor 17 that is already present in the holding tank 16. Such a holding tank 16 may be an outhouse holding tank, a septic tank, or other holding tank for holding sewage or gray water from a plumbing system, for example.

Figure 2:
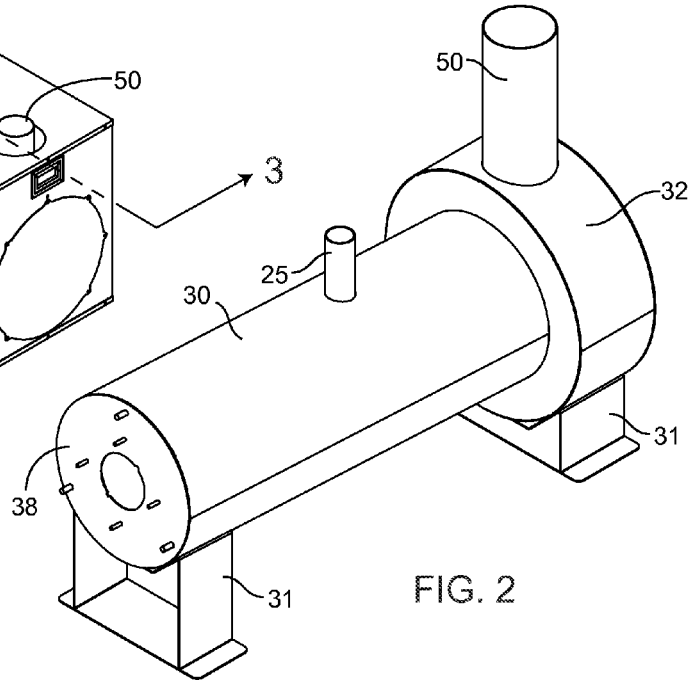
FIG. 2 is a perspective view of a burning chamber of the invention.

The system 10 comprises a pump 20 in fluid communication with the waste 15 in the holding tank 16, and which is adapted to pump waste 15 out of the holding tank 16 and into a substantially hollow burning chamber 30 (FIGS. 2 and 3). The burning chamber 30 includes a raised open end 38 and a lowered chimney end 32. The chimney end 32 is sealed with a selectively removable chamber plate 40 and includes a chimney 50 for venting exhaust fumes from within the burning chamber 30. The burning chamber 30 may be made of stainless steel or other suitably rigid metal material suitable for use with high temperatures. An internal layer of insulation 39 may be included to insulate the burning chamber 30 from the more extreme temperatures therein.

Figure 7:
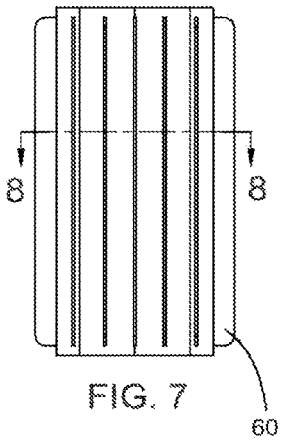
FIG. 7 is a bottom plan view of FIG. 6.
Figure 8:
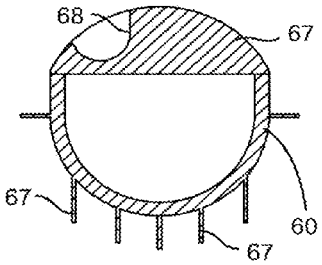
FIG. 8 is a cross-sectional view of the alternate embodiment of the waste tray, taken generally along lines 8-8 of FIG. 7.
Figure 9:
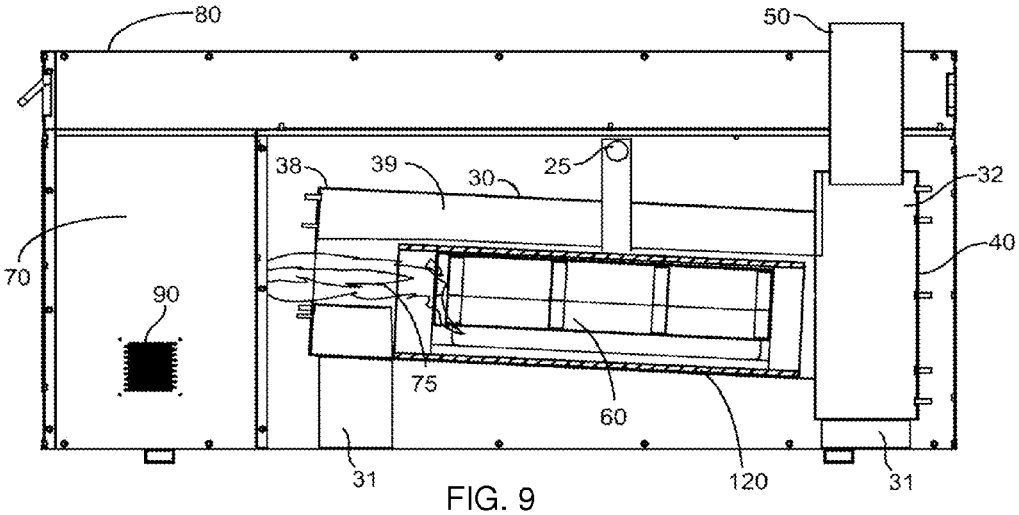
FIG. 9 is a cross-sectional view of the invention, illustrating an embodiment further including a heat insulating tube within the burning chamber.

A waste tray 60 (FIGS. 3, 4, and 7-9) is adapted to be slid into the burning chamber 30 through the chimney end 32 when the chamber plate 40 is removed. The waste tray 60 holds waste 15 received from the pump 20, such as through a conduit 25 (FIGS. 3 and 5). The waste tray 60 may further include heat sink fins 67, and is preferably made of Inconel®-type steel, cast iron, or other suitably high-temperature metal or alloy that is able to transmit heat efficiently, such that applying heat to one side thereof generally heats the entire waste tray 60. Further, such a waste tray 60 may be coated with a high-temperature resistance coating, such as those produced by Plasma Technology Incorporated of Torrance, Calif., or other suitable coating or treatment to increase efficiency and durability thereof. In one embodiment, additional heat sink fins 67 may include notches 68 for accepting air vent pipes, or the like, therethrough (FIGS. 7-9). Legs 31 may be used to incline the burning chamber 30 at an angle of between 5 and 20 degrees to the horizontal, for example. In one embodiment, the legs 31 are adjustable (not shown) so as to allow some adjustment to the angle of incline of the burning chamber 30. As such, any waste 15 overflowing the waste tray 60 will be directed towards the chimney end 32 of the burning chamber 30 and be captured therein.

A burner assembly 70 is fixed adjacent with the open end 38 of the burning chamber 30 and adapted to direct a flame 75 into the open end 38 of the burning chamber 30 to heat the waste tray 60 and the waste 15 therein. The burner assembly 70 includes access to a fuel source (not shown), such as natural gas, propane, butane, diesel fuel, or the like, and further includes an ignition source (not shown) and at least one burner nozzle (not shown) directed towards the open end 38 of the burning chamber 30 (FIG. 3). Such burner assemblies 70 are common in the art, such as in forced air heating units, pool heaters, and the like. Alternately, an electric burner assembly (not shown) may be utilized to sufficiently heat the waste tray 60.

A housing 80 is included to enclose the burner assembly 70 and the burning chamber 30. Such a housing 80 may be made of a sheet metal material supported by an internal frame, for example. At least one air vent 90 may be included to allow air to circulate freely within the housing 80 and in order to provide oxygen to the burning assembly 70.

A control system 100, such as a computerized controller, includes a power source (not shown) and is adapted to activate the pump 20 and the burner assembly 70. The control system 100 includes at least one temperature sensor 110 fixed proximate the chimney 50 for determining when the burning chamber 30 has reached a predetermined temperature, such as between 800 and 1,000 degrees Fahrenheit. Electrical conductors between the control system 100 and the temperature sensor 110, waste level sensor 17, and pump 20 carry power and signal information therebetween.

In use, when the waste level sensor 17 of the holding tank 16 indicates that a waste level in the holding tank 16 has exceeded a predetermined level, such as 60% capacity, for example, the control system 100 activates the pump 20 for a predetermined time, such as between 5 and 20 seconds, in order to pump a predetermined volume of the waste 15 into the waste tray 60, such as between 0.25 and 2.5 gallons, for example. The control system 100 then activates the burner assembly after the predetermined time of pumping and until the burning chamber 30 has reached the predetermined temperature, indicating that the waste 15 has been incinerated. More waste 15 can then be pumped into the waste tray 60 and incinerated in the same manner, until the waste level sensor 17 indicates that the waste level in the holding tank 16 has fallen to a predetermined minimum level, such as 5% of capacity, for example.

The control system 100 may include a timing means such that the pump 20 and burner assembly 70 are not activated except between certain times, such as in the early morning hours, for example. Any of the parameters of the control system 100 may be adjusted based on the requirements of any particular installation. For example, to increase efficiency, the predetermined maximum waste level may be set high and the predetermined minimum waste level may be set low so as to cause the system 10 to incinerate a maximum amount of the waste 15 when the waste tray 60 has already been heated to its incinerating temperature. Alternately, if in a particular installation it is determined that the waste holding tank 16 should never exceed 50% of its capacity, then the predetermined maximum waste level may be set to 50%.

In one embodiment, an insulating tube 120 is included in each burning chamber 30 (FIG. 9). As such, the structure of the burning chamber 30 is protected from the intense heat produced by each burner assembly 70. Such an insulating tube 120 may be made from heat insulating materials, such as ceramic, glass, or the like, such as produced by Western Industrial Ceramics, Inc. of Santa Fe Springs, Calif., for example. In one embodiment (not shown), multiple burner assemblies 70 and burning chambers 30 are included within the housing 80.

While a particular form of the invention has been illustrated and described, it will be apparent that various modifications can be made without departing from the spirit and scope of the invention. For example, the particular shape of the waste tray 60 may altered from that shown in the figures. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A waste incinerator system for incinerating waste in a holding tank having a waste level sensor, the system comprising:

a pump in fluid communication with the waste in the holding tank and adapted to pump waste out of the tank;

a substantially hollow burning chamber in fluid communication with the pump and adapted to receive a portion of the waste from the pump, the burning chamber including a raised open end and a lowered chimney end, the chimney end sealed with a selectively removable chamber plate and including a chimney for venting exhaust fumes from within the burning chamber;

a waste tray adapted to be slid into the burning chamber through the chimney end when the chamber plate is removed, and adapted to hold the waste received from the pump;

a burner assembly fixed with the raised open end of one of the burning chamber and adapted to direct a flame into the open end of the burning chamber to heat the waste tray and the waste therein, wherein the waste tray is configured to be slid into a position within the burning chamber such that it directly receives the flame on at least one surface;

a housing for holding the burner assembly and the burning chamber, the housing including at least one air vent to allow air to circulate therein; and a control system including at least one temperature sensor fixed proximate to the chimney and used for determining when the burning chamber has reached a predetermined temperature, wherein the control system is configured to:

activate the pump for a predetermined period of time when the waste level sensor of the holding tank indicates that a waste level in the holding tank has exceeded a predetermined level; and activate the burner assembly when the pump is deactivated after the predetermined period of time, wherein the burner assembly is activated until the burning chamber has reached the predetermined temperature, wherein the pump is deactivated while the burner assembly is activated; and wherein the controller repetitively causes sequential activation of the pump and the burner assembly until the waste level sensor indicates that the waste level in the holding tank has fallen to a predetermined minimum level.

2. The waste incinerator system of claim 1 wherein the waste tray further including a plurality of heat sink fins.

3. The waste incinerator system of claim 1 wherein the burning chamber further includes an insulating tube into which the waste tray may be inserted.

4. The waste incinerator system of claim 1 wherein the waste tray is made from a cast iron material and, wherein the at least one surface that receives the flames is coated with a heat resistant coating.

5. A method of incinerating waste in a holding tank having a waste level sensor, comprising:

a) providing a pump in fluid communication with the waste in the holding tank and adapted to pump waste out of the tank;

at least one substantially hollow burning chamber in fluid communication with the pump and adapted to receive a portion of the waste from the pump, each burning chamber including a raised open end and a lowered chimney end, the chimney end sealed with a selectively removable chamber plate and including a chimney for venting exhaust fumes from within the burning chamber;

one or more waste trays, each waste tray adapted to be slid into a corresponding burning chamber through the chimney end when the chamber plate is removed, and adapted to hold the waste received from the pump;

at least one burner assembly, each burner assembly fixed with the raised open end of a corresponding one of the at least one burning chambers and adapted to direct a flame into the open end of the burning chamber to heat the waste tray and the waste therein, wherein the waste tray is adapted and positioned to directly receive the flame on at least one surface;

a housing for holding the at least one burner assembly and the at least one burning chamber, the housing including at least one air vent to allow air to circulate therein; and a control system adapted to activate the pump and each burner assembly, and including at least one temperature sensor fixed proximate the chimney for determining when the at least one burning chamber has reached a predetermined temperature;

b) connecting the waste level sensor in the holding tank to the control system;

c) upon detection of the waste level sensor of the holding tank indicating that a waste level in the holding tank has exceeded a predetermined level, the control system activating the pump for a predetermined period of time;

d) activating each burner assembly after the predetermined time of pumping and until each burning chamber has reached the predetermined temperature;

e) repeating from step c) until the waste level sensor indicates that the waste level in the holding tank has fallen to a predetermined minimum level, wherein the pump is deactivated while the at least one burner assembly is activated.

6. A method of incinerating waste, comprising:

determining that a level of waste in a holding tank has exceeded a predetermined level based on an indication received from a waste level sensor of the holding tank;

activating a pump for a predetermined time when the waste level is determined to have exceeded the predetermined level, wherein the pump is deactivated after the predetermined time such that a desired volume of the waste is pumped into a waste tray; and activating a burner assembly when the pump is deactivated and until a burning chamber has reached a predetermined temperature, wherein the pump is deactivated while the at least one burner assembly is activated, wherein the one or more waste trays each have at least one surface that is positioned to directly receive a flame from and activated burner assembly, wherein waste in the waste tray is incinerated at the predetermined temperature, and wherein the waste tray is removably inserted within the burning chamber through a selectively removable chamber plate.

7. The method of claim 6, further comprising:

repetitively determining that the level of waste has exceeded the predetermined level, activating the pump, and activating the burner assembly until the waste level sensor indicates that the waste level in the holding tank has fallen below a predetermined minimum level.

8. The method of claim 7, wherein the predetermined minimum level is 5% of capacity of the holding tank.

9. The method of claim 6, wherein the predetermined time during which the pump is activated is between 5 and 20 seconds.

10. The method of claim 6, wherein the predetermined time during which the pump is activated is no more than 10 seconds.

11. The method of claim 6, wherein the desired volume of the waste to be pumped into the waste tray is between 0.25 and 2.5 gallons.

12. The method of claim 6, wherein the pump and the burner assembly are activated by a controller.

13. The method of claim 12, wherein the indication received from a waste level sensor of the holding tank is communicated to the controller.

14. The method of claim 6, and further comprising:

refraining from activating the pump and the burner assembly between a certain time of day.

15. The method of claim 14, wherein the certain time of day comprises early morning hours.

16. The method of claim 6, wherein the at least one burner assembly is deactivated while the pump is activated.

17. The waste incinerator system of claim 1, wherein the at least one burner assembly is deactivated while the pump is activated.

18. The method of claim 5, wherein the at least one burner assembly is deactivated while the pump is activated.

19. The waste incinerator system of claim 1, wherein the waste tray is made from a high-temperature metal or alloy coated with a heat resistant coating, and, wherein the at least one surface that receives the flames has a plurality of heat sink fins disposed thereon.

* * * * *